US006839940B2

(12) United States Patent
Harman

(10) Patent No.: US 6,839,940 B2
(45) Date of Patent: Jan. 11, 2005

(54) MUG HANDLE COVER AND METHOD FOR IDENTIFYING A MUG WITH A MUG HANDLE COVER

(76) Inventor: James E. Harman, 1540 SE. 12th St., Suite 5, Fort Lauderdale, FL (US) 33316

( * ) Notice: Subject to any disclaimer, the term of this patent is extended or adjusted under 35 U.S.C. 154(b) by 43 days.

(21) Appl. No.: 10/085,921

(22) Filed: Feb. 28, 2002

(65) Prior Publication Data

US 2003/0159245 A1 Aug. 28, 2003

(51) Int. Cl.[7] ..... A45C 13/26; B25G 3/00

(52) U.S. Cl. ..... 16/110.1; 16/425; 16/444; 16/422

(58) Field of Search ..... 16/110.1, 422, 16/425, 431, 436, 444, 446; 220/710.5, 771, 752; 40/330, 634, 611, 490, 649; 70/460, 456 R; 441/6; 215/395, 397; 294/171, 149

(56) References Cited

U.S. PATENT DOCUMENTS 1,975,241 A * 10/1934 Werber et al. ..... 220/592.17
3,635,382 A * 1/1972 Wilson ..... 294/166
4,120,073 A * 10/1978 Studebaker ..... 294/33
4,896,858 A 1/1990 Sokolski et al.
4,946,065 A * 8/1990 Goulter et al. ..... 220/495.1
4,982,989 A * 1/1991 Sweeny ..... 294/171
5,040,317 A 8/1991 Kadjevich
5,044,931 A 9/1991 Van Eerden et al.
5,261,176 A * 11/1993 David et al. ..... 40/324
5,339,549 A * 8/1994 David et al. ..... 40/324
5,343,776 A 9/1994 Falco et al.
5,347,684 A 9/1994 Jackson
5,368,393 A * 11/1994 Normann ..... 383/13
5,465,461 A 11/1995 Sandel
5,469,601 A 11/1995 Jackson
5,586,682 A 12/1996 Yeh
5,738,401 A * 4/1998 Fan ..... 294/171
5,775,756 A 7/1998 Rozenich
5,846,629 A 12/1998 Gwinn
5,867,868 A 2/1999 Ward
6,065,764 A * 5/2000 Moseley ..... 280/33.992
D459,949 S * 7/2002 Brennan ..... D7/536

FOREIGN PATENT DOCUMENTS

EP 0241410 A1 * 3/1987
EP 0241410 A1 * 10/1987

* cited by examiner

*Primary Examiner*—Chuck Y. Mah
(74) *Attorney, Agent, or Firm*—Loren Donald Pearson

(57) ABSTRACT

A molded thermoplastic mug handle cover clips to handle of mugs and other beverage containers, identifies the mug from other identical mugs, and is used for the purpose of advertising, branding, and mug distinction. The mug handle cover is a three-sided arcuate piece that is concave and arcuate. The two sides of the mug handle cover expand over the outer front surface width of the mug handle and retract to shape when the cover's side edges reach the interior side edge of the mug handle. At the outer edges of the interior of the two sides, a set of small half cone protrusions build in height from half way to the interior of the top to the outer edge of the sides and enable the mug handle cover to grip multiple sized mug handles.

23 Claims, 5 Drawing Sheets

MUG HANDLE COVER AND METHOD FOR IDENTIFYING A MUG WITH A MUG HANDLE COVER

BACKGROUND OF THE INVENTION

1. Field of the Invention

The invention relates to covers for mug handles and devices for identifying a particular mug from a plurality of mugs. In addition, the invention relates to advertising and branding tools at the point-of-sale within the beverage industry.

2. Description of the Related Art

Mugs are typically made of glass because glass is easy to clean, do not carry any unpleasant odors, and are inexpensive to produce. However, glass is not the only material that can be used for mug production. Porcelain, ceramics, and plastic may also be used in the manufacture of mugs.

The conventional mugs that are presently available today are produced without any distinguishing markings and are clear in color. They are typically round or paneled and are provided with a curved handle. However, some mugs do not have handles.

An individual mug cannot be distinguished from other mugs in a group. Because bars and other businesses use identically shaped mugs, the owner (i.e., the person drinking from the mug) cannot identify their mug when it is placed near other identical mugs. As a result, the drinker must either decide to get a new mug or risk sharing a mug.

SUMMARY OF THE INVENTION

It is accordingly an object of the invention to provide a mug handle cover and method for identifying a mug with a mug handle cover that overcomes the above-mentioned disadvantages of the heretofore-known devices and methods of this general type.

With the foregoing and other objects in view there is provided, in accordance with the invention, a mug handle cover. The mug handle cover includes a top being approximately as wide as a handle of a mug to be held. A first side extends in a direction from the top. A second side extends in the direction from the top and is laterally opposed to the first side. The first side and the second side are for holding the handle. For purposes of the invention, the term "approximately as wide as the handle" is meant to include tops that are larger and smaller than the width of the handle. In such cases, the sides can be angled to compensate for the width of the top while still clamping the handle.

In accordance with a further object of the invention, the first and second sides are at least as wide as an exterior side of the handle.

In accordance with a further object of the invention, the mug handle cover includes an inward protrusion on one of the sides. The protrusion is sized to releasably hold the handle when the mug handle cover is clipped on the mug. Typically, a protrusion being one-and-one-half millimeters thick is sufficient. A further inward protrusion can be added on the opposite; the further inward protrusion preferably opposes the first inward protrusion. The protrusion can be shaped like half of a cone having a semicircular base; the base is provided distal to the top of the mug handle cover. A point of the cone-shaped protrusion can be placed at a midpoint on the first side.

The mug handle cover can include a mark on the top, the first side, and/or the second side. The mark can be a color.

The mark can be molded in the surface (i.e., the top or either side). The mark can be etched in the surface. The mark can be a label. The label can be attached by adhesive or thermally bonded directly to the surface. The mark can be an advertisement.

The top of the mug handle cover can include a groove formed therein. A label rests in the groove and attaches to the top.

In accordance with a further object of the invention, the top has an interior top and the interior top abuts the handle.

In accordance with a further object of the invention, he top of the mug handle cover complements the shape of the handle, for example, by being arcuate.

In accordance with a further object of the invention, the top of the mug handle cover has two opposing parallel edges and the first and second sides connect to the top along the edges.

In accordance with a further object of the invention, the mug handle cover including the top and the first and second sides are constructed from a thermoplastic. The thermoplastic can be formed according to any of the following methods: extrusion, thermoforming, vacuum forming, rotating molding, rotary molding, resin transfer molding, sandwich molding, injection stamping, blow molding-injection, blow molding-extrusion, injection molding, and reaction injection molding. The thermoplastic can be selected from the following: acetals, acrylics, actylonitrile-butadine-styrene, actylonitrile-butadine-styrene polycarbonate alloy, actylonitrile-chlorinated pe-styrene, actylonitrile-styrene-acrylic, actylonitrile-styrene-acrylic polycarbonate alloy, alkyd, allyis, ASA polycarbonate alloy, bismaleimide, cellulosics, cyanatester, epoxy resins, ethylene-acid copolymer, ethylene-ethyl acrylate, ethylene-methyl acrylate, ethylene-vinyl acutate, ethylene-vinyl alcohol, ethylene-vinyl silane copolymer, fluoropolymers, foam rubber, ionomer, ketone-based polymer, liquid-crystal polymers, melamine, urea, neoprene, phenolic, polyamide, polyamide-imide, polycrylate, methacrylate-butadiene-styrene, nitrile-butadiene copolymer, polyarylether, polybutadiene, polybutylene, polybutylene terephthalate, polycarbonate alloy, polycarbonate, polycyclohexylenemethylene-terephthalute, polyesters, unsaturated, polyethylene, high density, polyethylene, linear low, polyethylene, polyethylene, naphalate, polyetheylene terephthalate, polyimides, polymethylpentene, polymide, polyphenylene oxide, polyphenylene sulfide, polypropylene, polysobutylene, polysthylene, polystyrene, polytheremide, polyurethanes, polyvinyl acetate, polyvinyl alcohol, polyvinyl chloride flexible, polyvinyl rigid, pellets, polyvinyl rigid, powder, polyvinylidene chloride, silicone, styrene-acrylonitrile, styrene-butadiene copolymer, styrene-maelic anhydride, sulfone-based polymer, thermoplastic elastomers, and vinyl ester. The mug handle can be made by including a thermoplastic additive selected from the following group an acid scavenger, an adhesion promoter, an antifoaming agent, an antifogging agent, a antioxidant, an antiozonant, an antislip agent, an antistatic agent, an antitack agent, a bonding agent, a carbon black, a chain extender, a chelating agent, a complexing agent, a clarifying agent, a cling agent, a coloring agent, a defoamer, a deodorant, a desiccant, a dispersing agent, a emulsifier, a flattening agent, a fluorescent whitening agent, a fragrance, a fresh keeping agent, a gel inhibitor, a infra red filter, a inhibitor, a leveling agent, a matting agent, a gloss agent, a melt strength enhancer, a metal deactivator, a nucleating agent, a oxygen absorber, a peptizer, a photoinitiator, a polymerization inhibitor, a polymerization initiator, a release agent, a slip agent, a styrene suppressant, a tackifier, a thickening agent, a thixotropic agent, a titanium dioxide, a viscosity modifier, a wax, and a wetting agent.

In accordance with a further object of the invention, a method identifies a mug having a handle among a plurality of identical mugs. The method includes marking a mug handle cover to be unique compared to the other mugs, for example by marking each mug handle cover with its own color. The next step is to releasably attach the mug handle cover to the mug. In particular, the mug handle cover can be clipped to the mug handle.

The mug handle cover avoids the shortcomings of currently manufactured mugs by providing a thermoplastic mug handle cover including a platform for advertising and branding. The thermoplastic can be produced in any color, which will allow the user to distinguish their mug from others that may be in close proximity. The mug handle cover is constructed to releasably attach to any mug handle and then be removed and attached to another mug handle. The design of the mug handle cover, with the inner side wall protrusions, allows this one mug handle cover to fit standard mugs, even though the handle of standard mugs vary in size and shape. Standard mugs are typically produced using glass. Unless the mug is marked during manufacturing or marked after production, there are no distinguishing features between two glass mugs of the same design. The three exterior sides of the mug handle cover can be marked to display any graphic or text message, thus providing a panoramic view of this graphic or text message. The mug handle cover can be utilized by any entity that would like to convey a message to any market segment that would use a mug to contain a beverage. The mug handle cover with its design will fit most mugs. The design also allows one mug handle cover to be attached to a mug, removed, and attached to another mug. The multiple thermoplastic colors will allow the user to distinguish their mug from any others and the availability to be marked allows any entity to place a graphic or text message promoting their product or association to the user. The mug handle cover transforms an unmarked mug into a viable marketing tool.

The mark can be three-dimensional and molded or sculpted on the top or sides. For example, a football or corporate loge could be added to the top or sides. Although the mug handle cover described below is described and illustrated as being adapted for use with standard mug handles, the present invention is not so limited and may include mug handle covers that provide for specific shapes and sizes for use with mug handles with special sizes and shapes. All such mug handle covers are likewise removable and easy to attach.

The mug handle cover works with any mug, pitcher, or handled beverage container (hereafter all collectively referred to as "mugs"). The mug handle cover is produced from any material having a wall and a handle, the handle having the top portion connected to the top of the wall and the bottom portion connected to the bottom of the wall forming a connected arcuate handle. The arcuate of the handle creates a defined space between the handle and the mug wall. Additionally, any round-bottomed mug without a handle.

The mug handle cover can be formed via molding. A mold usually includes two sections held together by a clamp with sufficient strength to withstand the pressure of the transferred molten plastic. The mold is provided with channels for heating, cooling, and venting.

The mug handle cover can have any of the exterior surfaces display a graphic or text message. This graphic or text message could be used in any way to convey a message, thought, or scene. The graphic or text message can be applied to any of the mug handle cover's sides by, but not limited to, any of the following application methods: thermal imprinting, pad printing, screen-printing, thermography, foil stamping, offset (lithography), gravure, foil stamping, engraving, shrink wrapping, printed sticker or adhesive, or any photo adhesion process.

The mug handle cover has a first sidepiece including an outer surface and inner surface that is adjoined to the exterior side surface of the arcuate mug handle. The inner surface, at each lateral end, has a small half cone protrusions and one, half-cone protrusion in the center, for a total of three protrusions. The two protrusions at each lateral end build from flush to the interior wall, to 1.5 millimeters in height. The height for all three protrusions builds from half way to the interior of the top piece to the edge of the sidepiece.

The mug handle cover has a second sidepiece including an outer surface and inner surface that adjoins the exterior side surface of the arcuate mug handle. The inner surface, at each lateral end, has small half cone protrusions and one half-cone protrusion in the center, for a total of three protrusions. The two protrusions at each lateral end build from flush to the interior wall, to 1.5 millimeters in height. The height for all three protrusions builds from half way to the interior of the top piece to the edge of the sidepiece. The first and second sidepieces are identical, face each other, and are separated by the width of the top piece. The two sidepieces are the parts of the mug handle cover that grip the exterior sides of the mug handle.

The mug handle cover has a top piece including an outer and inner surface that is adjoined to the exterior top surface of the arcuate mug handle. The top piece separates the two sidepieces and completes the three-sided mug handle cover. The interior surfaces, when attached to the mug, run the vertical length of the arcuate mug handle. The top exterior of the mug handle cover can be printed directly on, thermal imprinted, or be slightly recessed to all four edges, to allow for adhesive graphic placement or one constant surface. These configurations can accommodate the placement of an advertising/branding message to be viewed as the mug handle cover encompasses the handle of a mug.

The mug handle cover can be a self-contained piece that can be attached to and removed from the handle of a mug. Once applied, the mug handle cover encompasses the arcuate exterior top and exterior sides of the mug. The mug handle is gripped with the mug handle cover applied, in the same manner as it would be if the mug handle cover were removed. The mug handle cover does not occupy any of the space between the interior portion of the arcuate handle and the wall of the mug. The most effective way to grip the arcuate handle is to press the palm of the gripping hand against the outer surface of the of the arcuate handle along its vertical line, wrap the four fingers around the interior of the arcuate handle, and then press the thumb against the side of the mug wall. When attached, the mug handle cover grips the mug or handle and is further anchored by the pressure applied by the user's grip. The palm rests over the exterior surface of the top of the mug handle cover, the four fingers wrap around the exterior surface of the first side and pass through the space between the inner exterior of the mug handle and the wall of the mug. The users four fingers continue around the mug handle cover and the fingertips rest on the exterior arcuate of the second side. The thumb extends forward resting on the wall of the mug. This hand positioning causes the palm and four fingers to apply addition pressure to the exterior surfaces of the top and two sides of the mug handle cover. This design provides a more secure and firm grip the mug handle cover has on the mug handle. To remove the mug handle cover for use with another mug or to be taken by the user, the user merely grips the mug wall's circumference with one hand and using the thumb on the exterior of the second side and four fingers on the exterior surface of the first side and simply pulls the mug handle cover off the exterior side and top surfaces of the mug handle. The two sides of the mug handle cover expand as it passes over the mug handle's exterior sides and retracts back to shape once it clears the exterior top of the mug handle.

In accordance with a further object of the invention, a sleeve base would fit around the exterior base of any mug. The sleeve base would comprise a wide cylindrical substratum extending beyond the circumference of the mug. This substratum provides additional stability to the mug. Extending vertically up from the substratum and encompassing the entire exterior base of the mug would be the vertical walls of the sleeve. The vertical sleeve walls preferably extend three-quarters of an inch (¾") up the exterior base of the mug and fit the expanding contour of the exterior walls of the mug.

The mug handle cover can contain a graphic or text message to be used in any way to promote the brand, mark, or corporate identity of any enterprise. The graphic or text message could also be used for personal or business use by any entity corporate, private, governmental, or other. The message would be affixed to the exterior surfaces of the mug handle cover and when attached to the handle of a mug, would be visible when not in the palm grip of the user.

The mug handle cover's thermoplastic exterior can have a thermal label affixed to the thermoplastic. The thermal label containing information can be melded into the thermoplastic.

The mug handle cover's top exterior surface can have an inlay in the thermoplastic that encompasses the entire top exterior surface, leaving just the outer most edges at the original height. This inlay is about the approximate depth and an adhesive label/sticker. The label/sticker information stated would be affixed within the inlay borders with the height being consistent once the graphic is inlayed.

The mug handle cover's thermoplastic top exterior can remain a constant height and have the information affixed printed on the thermoplastic using one of the early-described printing methods. Additionally, the entire mug handle cover's exterior (all three sides) can also have the information affixed (printed) on them.

If thermoplastic is used, the thermoplastic can have color additives added so the mug handle cover can be formed using any available color. The thermoplastic can be formed using a solid color or multiple colors. The formed thermoplastic can use as many colors as needed to depict a certain look, i.e. zebra stripes, polka dots, etc.

Other features that are considered as characteristic for the invention are set forth in the appended claims.

Although the invention is illustrated and described herein as embodied in a mug handle cover, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
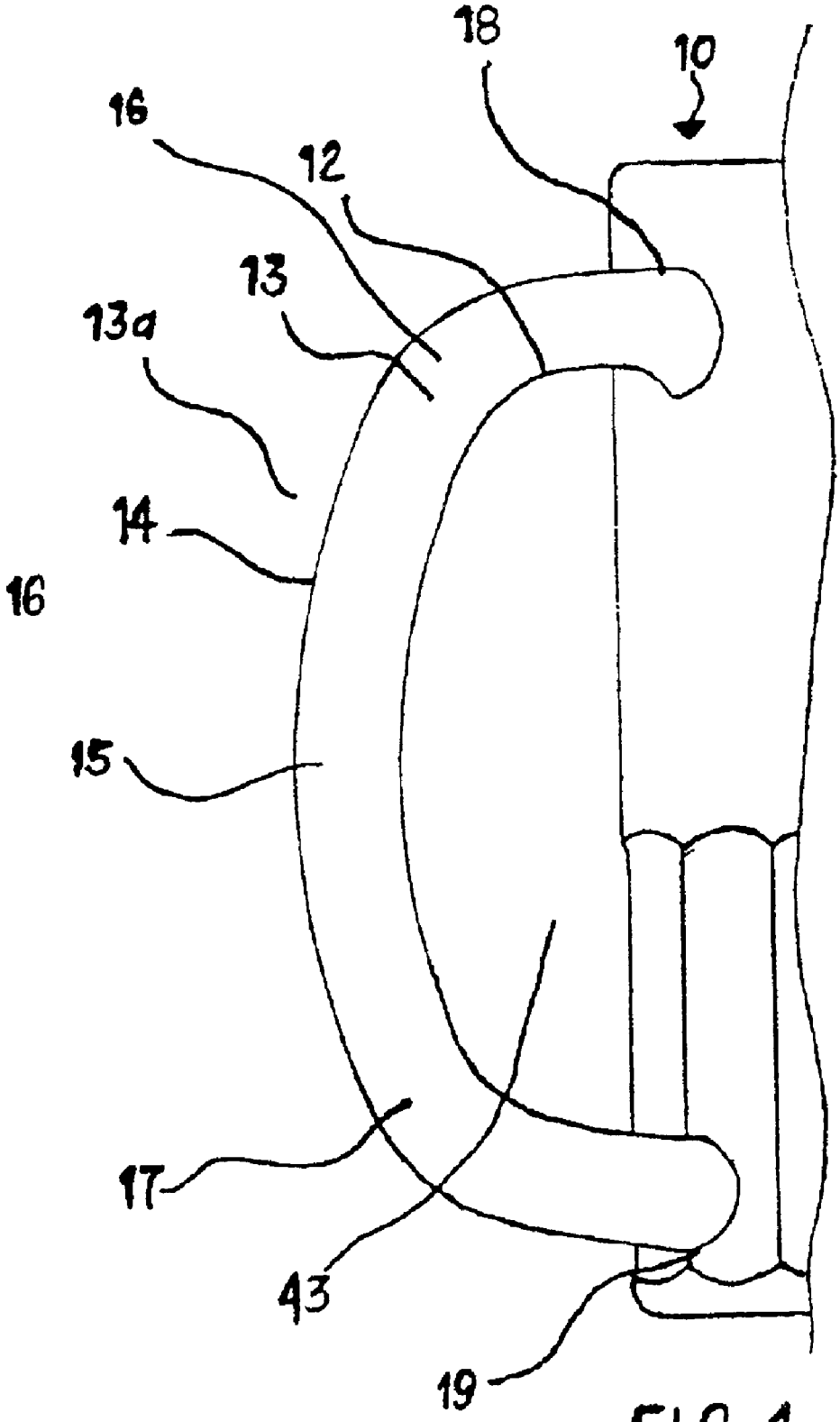
FIG. 1 is partial side view of a prior-art mug having a handle.
Figure 2:
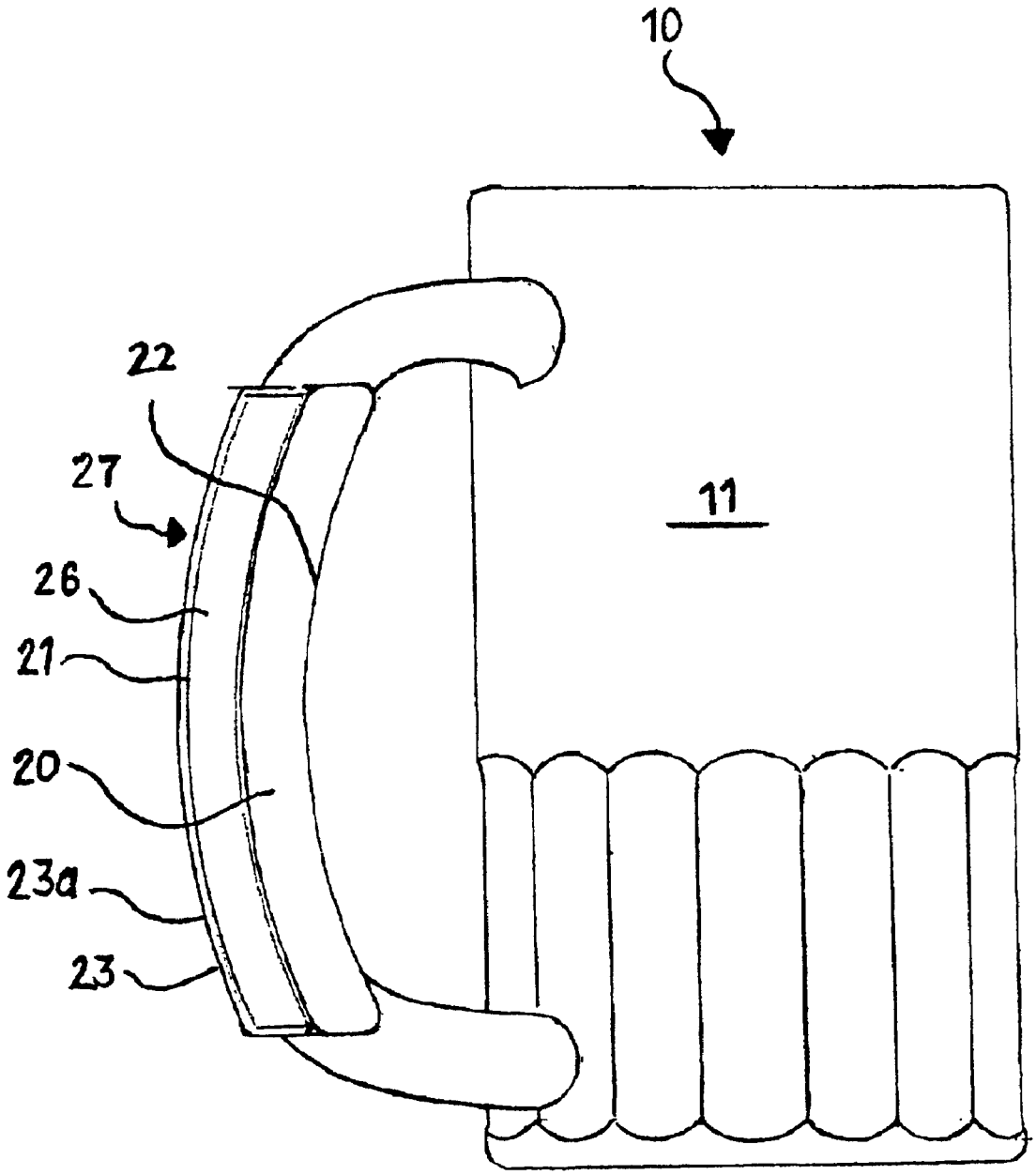
FIG. 2 is a perspective view of a mug handle cover attached to the handle of the mug.

Referring now to the figures of the drawing in detail and first, particularly, to FIG. 2 thereof, there is seen an arcuate mug handle cover generally marked by reference number 27. The mug handle cover 27 attaches to a mug handle 15 as shown in FIG. 1. Mug handles 15 are generally arcuate and attach to a mug 10 at two points. The mug handle cover 27 attaches to the exterior sides 13 and 13*a* and covers the vertical exterior top 14 of the mug handle 15. The mug handle cover 27, when attached, covers the arcuate area (between reference numbers 16 and 17) of the handle 15. However, in an alternate embodiment that is not shown, the mug handle cover 27 can be produced to fit the same three mug handle exterior sides 13, 13*a*, 14, but be increased in size to fit a larger portion (from reference number 18 to 19) on the handle 15. The mug handle cover 27 does not cover the interior surface 12 of the mug handle 15 and does not occupy any of the space 21 between the interior surface 12 of the mug 10 and the mug wall 11.

The mug handle cover 27 preferably is arcuate and complements the shape of the vertical exterior top 14. The mug handle cover 27 has three exterior sides 20, 21, and 23. The mug handle cover has a first exterior side 20, an exterior top 21, and a second exterior side 23. As shown in use with a conventional mug 10, the two sides 20 and 23 conform vertically to the arcuate mug handle 15. The first and second side's edges 22, 23*a* of the mug handle cover extend to the interior surface 12 of the handle 15.

The entire exterior top 21 can be marked with any graphic, logo, or text message, 26 to be viewed when the users does not have the mug and mug handle cover in their grasp. This graphics or text message can extend to cover the exterior sides 20, 23 and exterior top 21.

Figure 3:
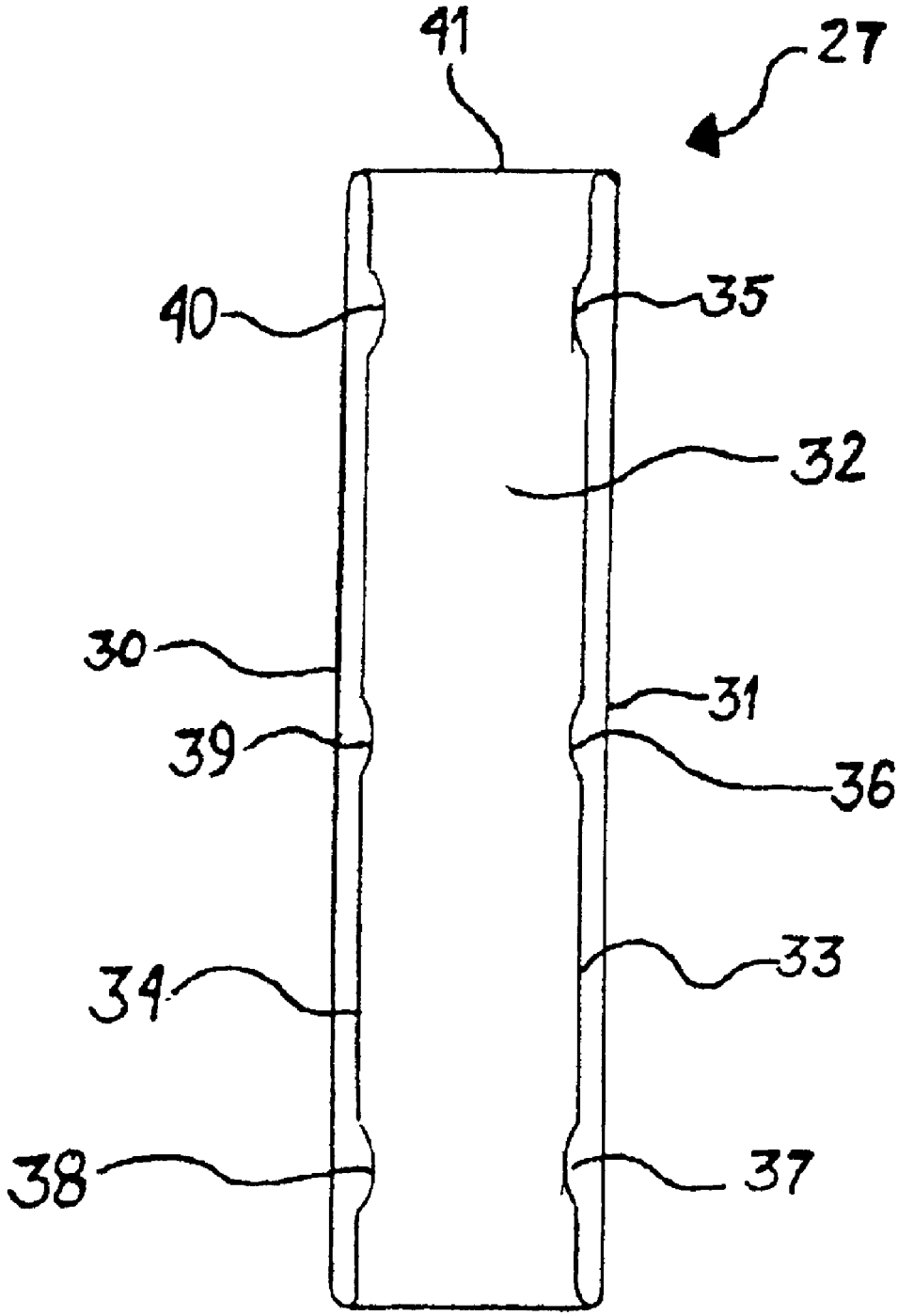
FIG. 3 is a rear view of the mug handle cover.

As shown in FIG. 3, the mug handle cover 27 has three interior sides: an interior top 32, an interior surface 33 of second side 23, and interior surface 34 of the first side 20. The exterior of the first side 30 and the exterior of the second side 31 are also shown to illustrate the thickness of the material used throughout the entire mug handle cover 27. Preferably, the material is flexible and resilient, for example, a thermoplastic. This thickness allows the first and second sides 20 and 23 of the mug handle cover 27 to expand around the exterior top 14 of the mug handle 15 and retract back to shape when the mug handle cover's interior top 32 abuts the exterior top 14 of a mug handle 15. Once the interior top 32 of the mug handle cover 27 and the exterior top 14 abut, the mug handle cover's interior surface edge 33 and interior surface edge 34 retract back to shape at the interior surface 12 of the mug handle 15. This expansion and contraction around the mug handle 15 due to the material's flexibility and resiliency affords a sound grip of the mug handle cover 27. In addition to the expansion and contraction of the mug handle cover's sides 20 and 23, there are three sets of protrusions 35, 36, 37, 38, 39, and 40 to increase grip. The six protrusions are identified by their location: upper interior bottom edge of second side 35, middle interior bottom edge of second side 36, lower interior bottom edge of the second side 37, lower interior bottom edge of the first side 38, middle interior bottom edge of first side 39, and upper interior bottom edge of first side 40 are space evenly on each interior side walls. These six protrusions 35, 36, 37, 38, 39, and 40 laterally increase from the interior top to first and second side's edges. This increase in height, when attached to the mug handle 15, helps the mug handle cover's grip by filling in and gripping the mug's handle as it curves to its interior surface 12. The mug handle cover's vertical top and bottom 41 and 42 depict where the arcuate stops.

Figure 4:
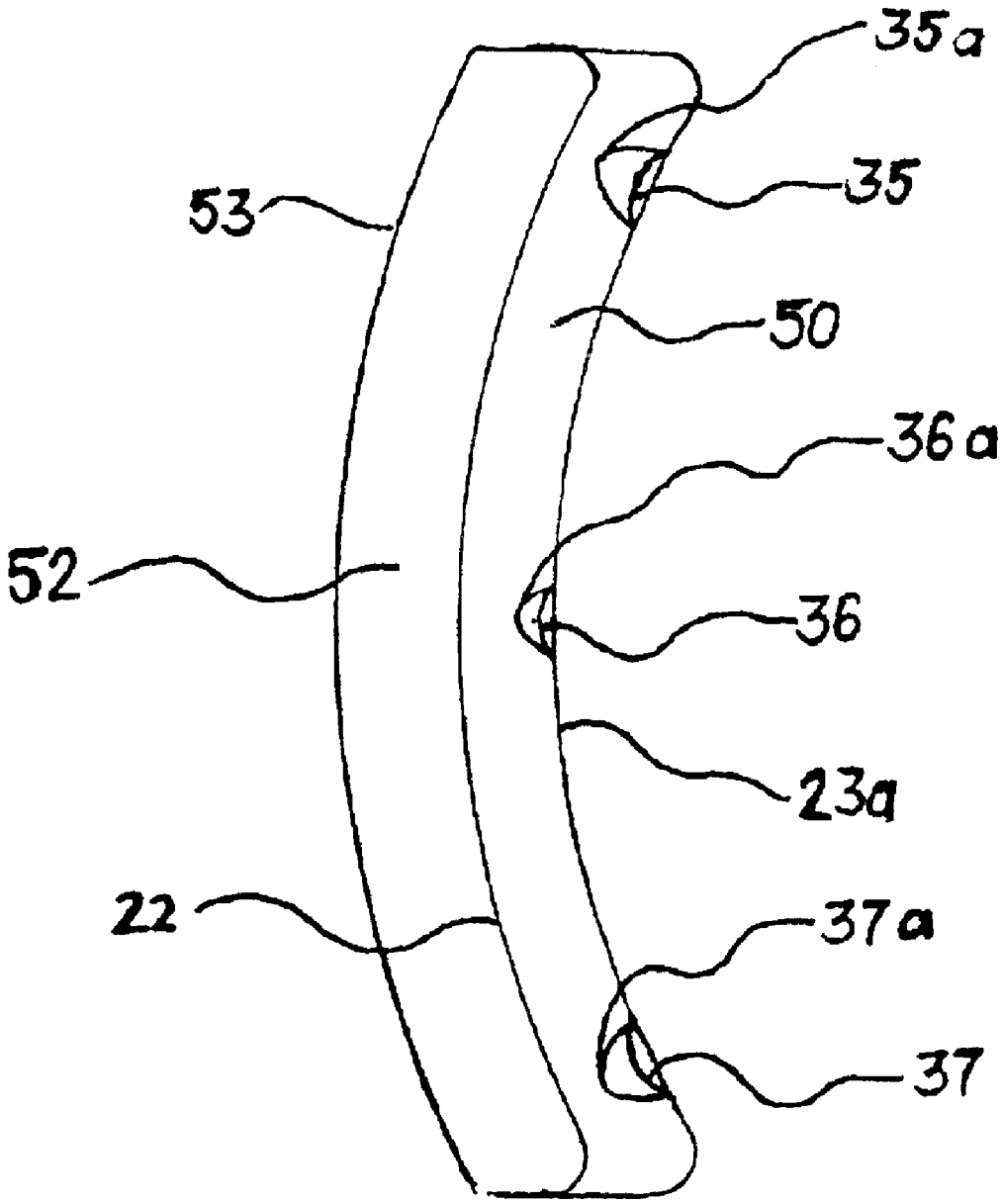
FIG. 4 is a right-side elevational view of the mug handle cover.
Figure 5:
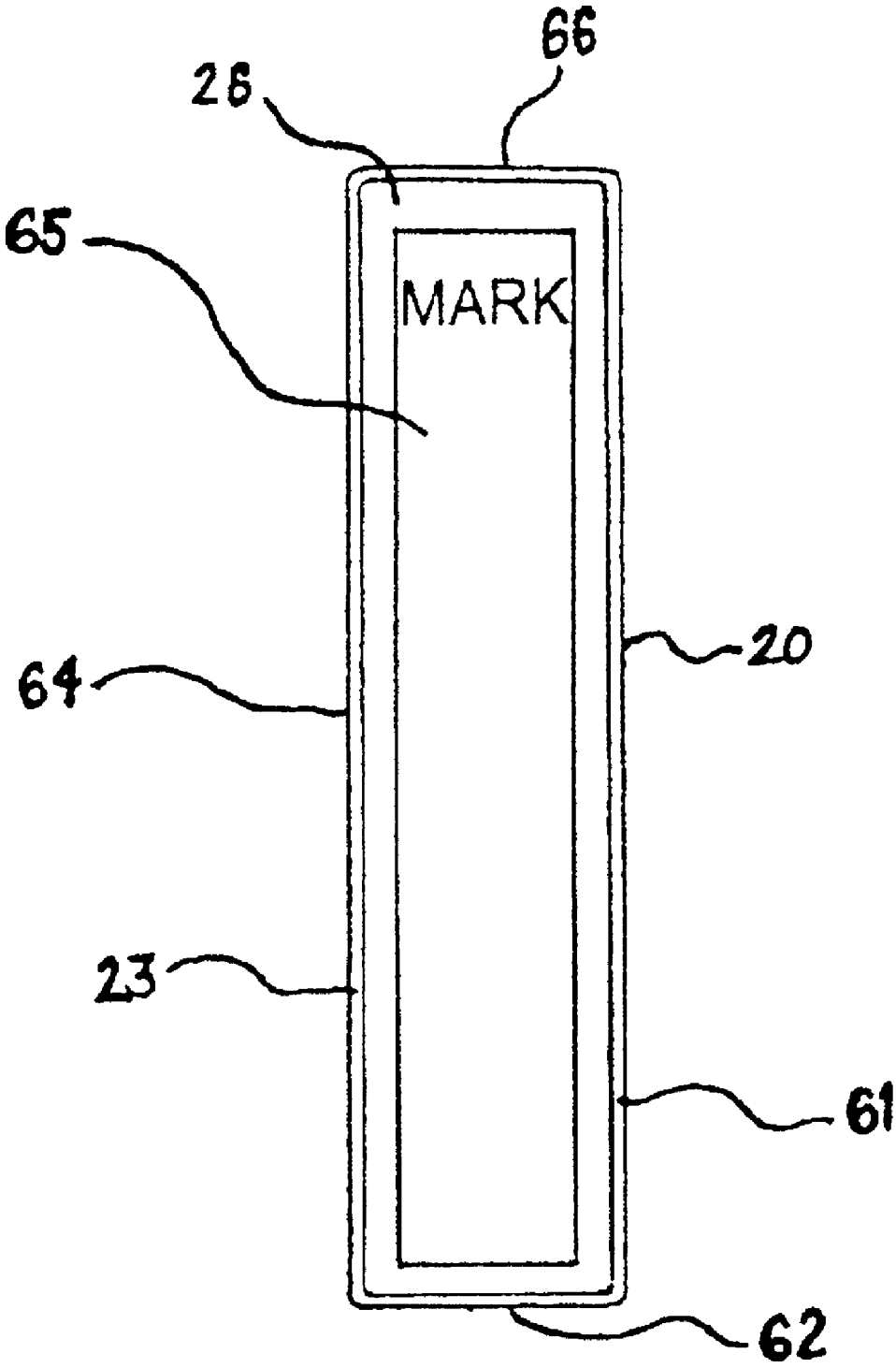
FIG. 5 is a front view of the mug handle cover.

The six protrusions 35, 36, 37, 38, 39, and 40 extend laterally inward from the interior top 41 to the first and second side's bottom edges 22 and 23*a*. As shown in FIG. 4, the protrusions 35, 36, and 37 (as well as protrusions 38, 39, and 40, which are not visible in FIG. 4) build (i.e. increase medially in thickness) from a midpoint 35*a*, 36*a*, and 37*a* between the interior top 41 and the edges 22 and 23*a* meets where the protrusions 35, 36, 37, 38, 39, and 40 are flush with the interior surfaces 33 and 34. In a preferred embodiment, the protrusions 35, 36, 37, 38, 39, and 40 build one-and-one-half millimeters (1.5 mm) from the midpoint 35*a*, 36*a*, and 37*a* to the side's interior bottom edge 22 and 23*a*. The protrusions 35–37 and 38–40 build to the interior bottom edge of the first and second edges 23 and 22, respectively. The handle grip cover's side exterior walls do not have protrusions. The number of protrusions 35, 36, 37, 38, 39, and 40, is not critical, as any number of sets can be provided without departing from the spirit and scope of the present invention.

Embodiments using a single protrusion are possible. However, the protrusions preferably occur in laterally symmetrical pairs; i.e., 35 and 40, 36 and 39, and 37 and 38.

Preferred embodiments of the protrusions 35, 36, 37, 38, 39 and 40 are shown in FIG. 4. Other alternative designs for the protrusions can be used as the gripping instrument without departing from the spirit and scope of the present invention. As a non-limiting example, a continuous (as opposed to medially increasing) protrusion running the entire length of the bottom interior edges 22 or 23*a* could be formed to grip the mug handle 15.

The mug handle cover 27 can mark the exterior top 26 and sides 20 and 23. The top exterior 26 provides a focal point in which to place the mark 65. The mug handle cover's, exterior second side 20, exterior first side 23, lower edge 62 of exterior top side 26, and upper edge 66 of exterior top side 26, can all be marked to create a panoramic display of the graphic or text message. However, the most obvious place to place the mark is on the exterior top surface 26 of the mug handle cover 27. The mention of the additional side markings is used a non-limiting example of additional markings that can be provided without departing from the spirit and scope of the present invention. The mark 65 preferably is an adhesive label. In other embodiments, the mark can be thermally bonded to the topside 62. The mark 65 preferably is an adhesive label. In other embodiments, the mark 65 can be thermally boded to the topside 62 or can be molded or etched into the topside 62 as well. The mark can be a sculpted three-dimensional piece as well.

To attach the mug handle cover, the user would pick up the mug handle cover 27 with their thumb on the exterior of the second surface 23 and their four fingers on the exterior of the first surface 20. The user would place the interior surface edges 33 and 34 to the exterior sides 13 and 13*a* of the mug handle 15. The user applies pressure, on the mug handle cover 27, towards the wall 11 of the mug 10. The pressure causes an expansion of the first and second sides 20 and 23 over the exterior sides 13 and 13*a* of the mug handle 15. The user applies pressure until the top interior surface 41 abuts the top exterior surface 41 of the mug handle 15, at which time the sides of the mug handle 13 and 13*a* are surrounded by the interior sides 20 and 23 where the six protrusions 35, 36, 37, 38, 39, and 40, retract into the space where the mug handle rounds. The building of the protrusions 34, 35, 36, 37, 38, 39, and 40 fill the area where the mug's exterior sidewalls round into the interior of the mug handle 12.

The mug handle cover 27 is preferably made of plastic or hard rubber, although other materials can also be used without departing from the spirit and scope of the present invention. The thickness of the plastic for the mug handle cover preferably spans one-half to three-quarters millimeters (0.50–0.75 mm).

Thus, the mug handle cover 27 provides a simple and effective device for marking and differentiating standard mugs. The mug handle cover 27 is easy to use and can be attached at the handle 15 of any mug 10. Because of the simple design and construction, the mug handle cover is inexpensive to manufacture, so it would be a highly feasible advertising and branding tool for any entity that would like to convey a message to users of beverage mugs. The detachable handle allows the user to remove the mug handle cover off a mug and take the mug handle cover with them, displaying the graphic or text to all that encounter it.

I claim:

1. A mug handle cover for marking a mug, comprising:

a top being approximately as wide as a handle and having an interior top, said interior top abutting the handle;

a first side extending in a direction from said top and having an inward cone-shaped protrusion on said first side, said protrusion having a base, said base being distal to said top; and a second side extending in the direction from said top and being laterally opposed to said first side;

said first side and said second side being configured to releasably hold the handle.

2. The mug handle cover according to claim 1, wherein said first and second sides are at least as wide as an exterior side of the handle.

3. The mug handle cover according to claim 1, wherein said protrusion is one-and-one-half millimeters thick.

4. The mug handle cover according to claim 1, including a further inward protrusion on said second side, said further inward protrusion opposing said first inward protrusion.

5. The mug handle cover according to claim 1, wherein:

a midpoint is provided on said first side; and a point of said cone is at said midpoint.

6. The mug handle cover according to claim 1, including a mark on a surface selected from the group consisting of said top, said first side, and said second side.

7. The mug handle cover according to claim 6, wherein said mark is a color.

8. The mug handle cover according to claim 6, wherein said mark is molded in said surface.

9. The mug handle cover according to claim 6, wherein said mark is etched in said surface.

10. The mug handle cover according to claim 6, wherein said mark is a label.

11. The mug handle cover according to claim 10, wherein said label includes adhesive for attaching said label to said surface.

12. The mug handle cover according to claim 10, wherein said label is thermally bonded to said surface.

13. The mug handle cover according to claim 1, wherein:

said top includes a groove formed therein; and a label rests in said groove and attaches to said top.

14. The mug handle cover according to claim 6, wherein said mark is an advertisement.

15. The mug handle cover according to claim 1, wherein said top is arcuate.

16. The mug handle cover according to claim 1, wherein said top complements a shape of the handle.

17. The mug handle cover according to claim 1, wherein said top has two opposing parallel edges and said first and second sides connect to said top along said edges.

18. The mug handle cover according to claim 1, wherein said top and said first and second sides are constructed from a thermoplastic.

19. The mug handle cover according to claim 18, wherein said top and said first and second sides are constructed by a method selected from the group consisting of extrusion, thermoforming, vacuum forming, rotating molding, rotary molding, resin transfer molding, sandwich molding, injection stamping, blow molding-injection, blow molding-extrusion, injection molding, and reaction injection molding.

20. The mug handle cover according to claim 18, wherein said thermoplastic is selected from the group consisting of acetals, acrylics, actylonitrile-butadine-styrene, actylonitrile-butadine-styrene polycarbonate alloy, actylonitrile-chlorinated pe-styrene, actylonitrile-styrene-acrylic, actylonitrile-styrene-acrylic polycarbonate alloy, alkyd, allyis, asa polycarbonate alloy, bismaleimide, cellulosics, cyanatester, epoxy resins, ethylene-acid copolyuter, ethylene-ethyl acrylate, ethylene-methyl acrylate, ethylene-vinyl acutate, ethylene-vinyl alcohol, ethylene-vinyl silane copolymer, flucropolymers, foam rubber, ionomer, ketone-based polymer, liquid-crystal polymers, melamnine, urea, neoprene, phenolic, polyamide, polyamide-imide, polycrylate, methacrylate-butadiene-styrene, nitrile-butadiene copolymer, polyarylether, polybutadiene, polybutylene, polybutylene terephthalate, polycarbonate alloy, polycarbonate, polycyclohexylenemethylene-terephthalute, polyesters, unsaturated, polyethylene, high density, polyethylene, linear low, polyethylene, polyethylene, naphalate, polystheylene terephthalate, polyimides, polymethylpentene, polymide, polyphenylene oxide, polyphenylene sulfide, polypropylene, polysobutylene, polysthylene, polystyrene, polytherermide, polyurethanes, polyvinyl acetate, polyvinyl alcohol, polyvinyl chloride flexible, polyvinyl rigid, pellets, polyvinyl rigid, powder, polyvinylidene chloride, silicone, styrene-acryl acrylonitrile, styrene-butadiene copolymer, styrene-maelic anhydride, sulfone-based polymer, thermoplastic elastomers, and vinyl ester.

21. The mug handle cover according to claim 18, made by including a thermoplastic additive selected from the following group an acid scavenger, an adhesion promoter, an antifoaming agent, an antifogging agent, a antioxidant, an antiozonant, an antislip agent, an antistatic agent, an antitack agent, a bonding agent, a carbon black, a chain extender, a chelating agent, a complexing agent, a clarifying agent, a cling agent, a coloring agent, a defoamer, a deodorant, a desiccant, a clispeising agent, a emulsifier, a flattening agent, a fluorescent whitening agent, a fragrance, a fresh keeping agent, a gel inhibitor, a infra red filter, a inhibitor, a leveling agent, a matting agent, a gloss agent, a melt strength enhancer, a metal deactivator, a nucleating agent, a oxygen absorber, a peptizer, a photoinitiator, a polymerization inhibitor, a polymerization initiator, a release agent, a slip agent, a styrene suppressant, a tackifier, a thickening agent, a thixotropic agent, a titanium dioxide, a viscosity modifier, a wax, and a wetting agent.

22. A method for identifying a mug having a handle among a plurality of identical mugs, which comprises:

providing a mug handle cover including:

a top being approximately as wide as a handle; and having an interior top;

a first side extending in a direction from said top and having an inward cone-shaped protrusion on said first side, said protrusion having a base, said base being distal to said top; and a second side extending in the direction from said top and being laterally opposed to said first side;

said first side and said second side being configured to releasably hold the handle;

marking the mug handle cover to be unique;

releasably attaching the mug handle cover to the mug; and abutting said interior top to the handle;

releasing the mug handle cover from the mug when finished drinking from the mug.

23. The method according to claim 22, which further comprises clipping the mug handle cover to the handle of the mug.

* * * * *